United States Patent [19]

Van Santen

[11] 4,221,362

[45] Sep. 9, 1980

[54] JACK POST

[75] Inventor: Gordon L. Van Santen, Woodstock, Canada

[73] Assignee: Pliotron Corporation of Canada Limited, Ontario, Canada

[21] Appl. No.: 939,115

[22] Filed: Sep. 5, 1978

[30] Foreign Application Priority Data

Sep. 6, 1977 [GB] United Kingdom ..... 37203/77

[51] Int. Cl.[3] ..... B66F 3/10

[52] U.S. Cl. ..... 254/98; 248/354 P; 254/133 A

[58] Field of Search ..... 254/98–103, 254/DIG. 1, DIG. 4, 133 A; 248/354 P, 354 S, 354 R

[56] References Cited

U.S. PATENT DOCUMENTS

| | | | |
|---|---|---|---|
| 1,796,173 | 3/1931 | Warren | 254/98 |
| 2,504,291 | 4/1950 | Alderfer | 254/98 |
| 3,942,904 | 3/1976 | Morris | 248/354 P X |
| 4,083,530 | 4/1978 | Linnepe | 254/133 A X |

FOREIGN PATENT DOCUMENTS

| | | | |
|---|---|---|---|
| 378175 | 8/1932 | United Kingdom | 248/354 P |

*Primary Examiner*—Robert C. Watson

*Attorney, Agent, or Firm*—Brumbaugh, Graves, Donohue & Raymond

[57] ABSTRACT

A jack post includes two telescopic square section tubes. Narrow top and bottom plates are provided for the post, the plates being of a size for insertion within one of the tubes, and a cross pin is provided for insertion transversely through selected bores in the telescoped tubes.

3 Claims, 5 Drawing Figures

JACK POST

The present invention relates so called jack posts, i.e. telescopic supporting posts used in buildings. In North American house building practice, such posts are commonly used to support joists at ground floor level above a concrete basement floor, but of course jack posts may be used in many other situations.

A typical conventional jack post is shown in U.S. Pat. No. 2,504,291 to Alderfer, issued Apr. 18, 1950. This comprises round telescoping tubes, including an outer base tube and an inner, upper tube, the upper tube having transversely aligned pairs of bores which can receive a cross pin in different positions, the outer ends of the cross pin resting on top of the base tube to hold the two tubes in extended position. The top end of the upper tube carries a nut which receives an adjusting screw, the upper end of this screw terminating in a spigot which engages a top plate which bears against the item to be suppoted. The base of the lower tube rests on a similar plate.

This conventional type of jack post cannot be packaged very conveniently. The top and bottom plates are usually square, and so do not fit into a long narrow package used for the two tubes. The small spigot end of the screw always projects out of the nut even when the screw is screwed into its inner most position. Also, since the tubes are round they cannot be conveniently stacked unless they are contained in rectangular boxes.

The present invention provides a jack post which is much easier to store and package than the conventional jack post, and which also has other advantages in use.

According to one aspect of the invention, there is provided a jack post having two telescoping tubes which are of square cross-section. The use of square section tubes at once makes the jack posts much easier to package, since these can merely be wrapped with a covering material and then can be stacked, without the use of any boxes.

In accordance with another aspect of the invention, narrow elongated top and bottom plates for the jack post are provided which are so dimensioned that they can easily be packaged with the jack post. Preferably, such top and bottom plates have a width which allows them to be placed within the base tube of the jack post, diagonally where the base tube is square. The length of the two plates may be such that their combined length, added to the length of the inner tube, approximately equals the length of the outer tube, so that the inner tube and two plates, along with the cross pin, and the screw, can all be accommodated within the outer tube.

The use of a special screw and nut combination, as described in more detail in our co-pending application No. filed on even date herewith, enables the screw to be contained very largely within the end of the outer tube.

The invention will be described in more detail with reference to the accompanying drawings, in which.

Figure 1:
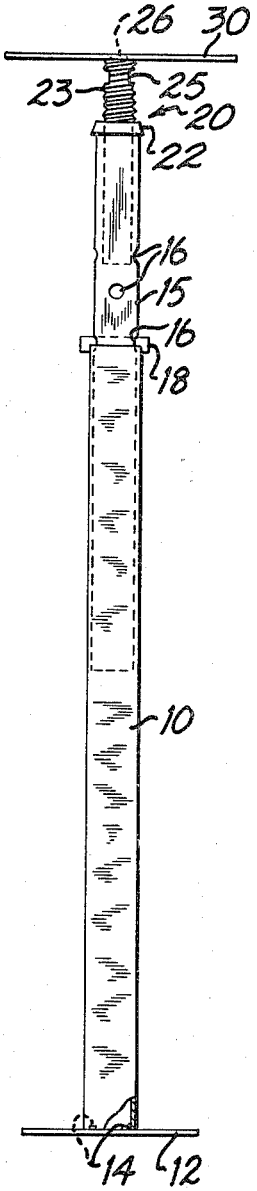
FIG. 1 shows a side elevation of the erected jack post.
Figure 4:
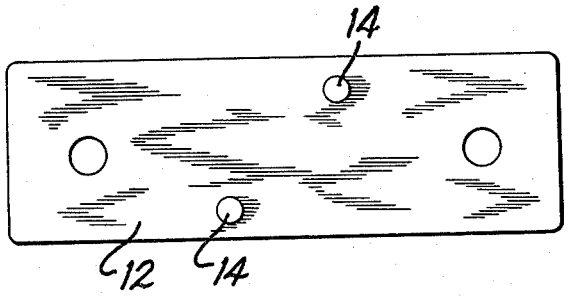

Referring to FIG. 1, the jack post comprises a steel outer tube 10 of square section, the base of which rests on a flat bottom plate 12. The bottom plate 12 is an elongated plate as shown in FIG. 4, sized to fit diagonally with tube 10 for packaging, and having two upstanding studs 14 which are received in opposite diagonal corners of the bottom of the tube 10 to locate the bottom plate.

The tube 10 telescopingly receives an upper square section inner tube 15 which is shorter in length than the outer tube 10, and which has pairs of horizontally aligned bores 16 which can receive a cross pin 18, the pin having small grooves towards its outer ends which engage and rest on the top end of the base tube 10. The different bores 16 allow for major variations in the overall height of the jack post.

Figure 3:
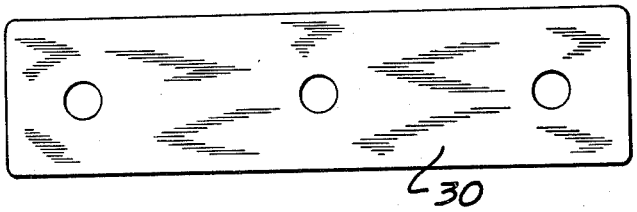
FIGS. 3 and 4 show top plan views respectively of the top and bottom plates.

The top end of tube 15 carries a screw and nut combination 20 which is more fully described in our co-pending U.S. Pat. application No. 939,116 filed concurrently herewith. This combination includes a nut 22 the outer margin of which rests on top of tube 15, and a screw 23 which extends through this nut and which has an unthreaded lower end portion 23*a* preventing the screw from being totally unscrewed from the nut. Close to its upper end, the screw 23 has a pair of flats 25 for receiving a wrench. The top end of the screw has a spigot 26, which is received in the central hole of a top plate 30 shown in FIG. 3. This top plate is of an elongated form allowing it to fit diagonally within tube 10. The outer holes in the plate 30 allow this to be attached to a beam or like member. Adjustment of the screw 23 by a wrench applied to flats 25 allows for small adjustment of the jack post height.

The square section jack post can be arranged to fit within a standard wall or partition, and is easier to attach to such wall or partition than a standard round post.

Figure 5:
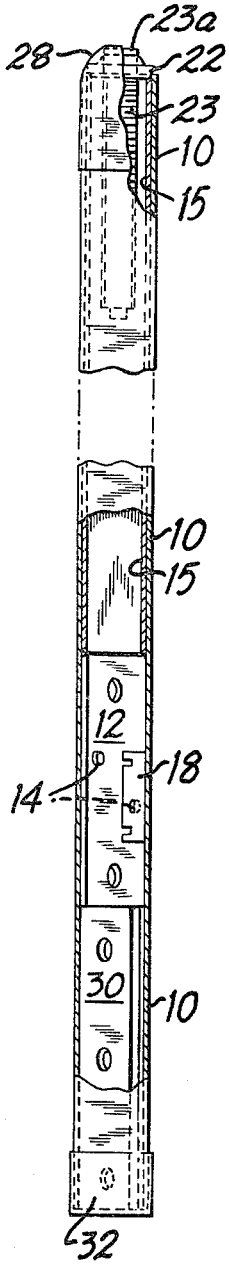
FIG. 5 shows a partially cut away view of the jack post as prepared for packaging.

FIG. 5 shows the unique manner in which the components of this jack post can all be packaged, virtually within the confines of the outer tube 10.

Firstly, the bottom and top plates 12 and 30 are placed in diagonal manner inside the lower part of the outer tube 10. These are preferably arranged at right angles to each other so that they cannot overlap and become jammed. The cross pin 18 is also placed in the lower end of tube 10, and the bottom end of the tube is then closed by a cap 32.

Figure 2:
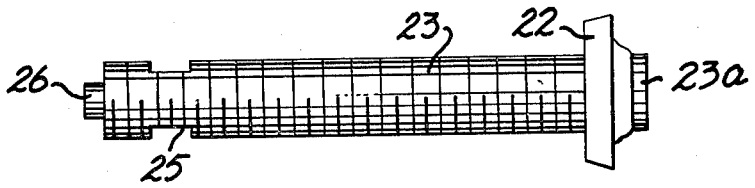
FIG. 2 shows a view of the screw and nut combination used at the top end of the jack post, with the nut positioned as for the packaging position.

The upper tube 15 is allowed to slide into the outer tube 10 until it reaches the top of plate 12, the length of these elements being such that in this condition the upper end of the inner tube is just within the end of the outer tube. The screw 23 and nut 22 having been removed from the upper tube, the nut is then screwed to the unscrewed end 23*a* of the screw, as shown in FIG. 2, and the screw is then placed within the inner tube, so that almost the entire length of the screw extends within this inner tube, i.e. the arrangement of the screw and nut is reversed relative to the operative arrangement of FIG. 1. The sides of nut 22 is tapered and dimensioned so that the smaller part of this just enters within the outer tube end. Packaging material 28 is then applied over the end 23*a* of the screw to hold these items in place.

The packaging may, if required, be completed by the addition of paper or some other material to the tube, but it will be seen that no carton is required. The package contains all of the items of the jack post so that there is no chance of a customer receiving less than a full set of parts. The packaged jack post can easily be stacked, by virtue of the use of square tubes, and requires less space in storage than the conventional round tubes, and is safer when stacked.

Although as indicated there are many advantages to the use of square tubes for the jack post, this is not an essential in connection with the packaging concept, and round tubes could be used in association with end plates which will fit within the outer base tube.

We claim:

1. A jack post having inner and outer telescoping tubes, and top and bottom plates, the inner tube having transversely aligned pairs of bores for receiving a cross pin so that the post can be held in extended position with the cross pin so that the post can be held in extended position with the cross pin positioned through one pair of bores and resting on the top of the outer tube, and wherein both said outer and inner tubes are of square cross-section, said plates are substantially flat, are adapted to fit on the jack post in a fixed position generally perpendicular to the axis of the tubes, and have a width sufficiently small to allow these to be placed diagonally within the outer tube, said plates being elongated with a length longer than the outer tube width and the combined length of the plates and the inner tube being no greater than substantially the length of the outer tube, whereby a compact package can be made of the entire jack post assembly.

2. A jack post having inner and outer telescoping tubes and top and bottom plates, the inner tube having transversely aligned pairs of bores for receiving a cross pin so that the post can be held in extended position with the cross pin positioned through one pair of bores and resting on the top of the other tube, both said outer and inner tubes being of square cross-section, said top and bottom plates being elongated and having a width sufficiently small to allow these to be placed diagonally within the outer tube, and the combined length of the top and bottom plates, added to the length of the inner tube, being approximately equal to the length of the outer tube.

3. A jack post having inner and outer telescoping tubes, the inner tube having transversely aligned pairs of bores for receiving a cross pin so that the post can be held in extended position with the cross pin through one pair of bores and resting on the top end of the outer tube, the jack post further comprising top and bottom plates each having a width sufficiently small to allow these to be placed within the outer tube, and the combined length of the top and bottom plates, added to the length of the inner tube, being approximately equal to the length of the outer tube.

* * * * *

UNITED STATES PATENT AND TRADEMARK OFFICE

CERTIFICATE OF CORRECTION

PATENT NO. : 4,221,362

DATED : September 9, 1980

INVENTOR(S) : Gordon Lloyd Van Santen

It is certified that error appears in the above-identified patent and that said Letters Patent are hereby corrected as shown below:

Col. 1, line 4, after "relates" insert -- to --;

Col. 1, line 21, "suppoted" should read -- supported --;

Col. 2, line 59, "sides ... is" should read --sides ... are--;

Col. 3, lines 15-16, delete the repetition, "so that the post can be held in extended position with the cross pin".

Signed and Sealed this

*Tenth* Day of *March 1981*

[SEAL]

*Attest:*

RENE D. TEGTMEYER

*Attesting Officer*

*Acting Commissioner of Patents and Trademarks*